US011505399B1

(12) United States Patent
Al Harbi

(10) Patent No.: US 11,505,399 B1
(45) Date of Patent: Nov. 22, 2022

(54) ELECTRONIC CIRCUIT BOARD BAG

(71) Applicant: GIFTEDNESS AND CREATIVITY COMPANY, Safat (KW)

(72) Inventor: Alaa Suleiman Ghazai Al Harbi, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/737,149

(22) Filed: May 5, 2022

(51) Int. Cl.

| | |
|---|---|
| ***B65D 90/20*** | (2006.01) |
| ***B65D 85/30*** | (2006.01) |
| ***B65D 25/28*** | (2006.01) |
| ***B65D 25/24*** | (2006.01) |
| ***B65D 25/04*** | (2006.01) |

(52) U.S. Cl.
CPC ..... *B65D 85/30* (2013.01); *B65D 25/04* (2013.01); *B65D 25/24* (2013.01); *B65D 25/2826* (2013.01); *B65D 2585/86* (2013.01)

(58) Field of Classification Search
CPC ..... B65D 85/30; B65D 25/00; B65D 25/24; B65D 25/2826; B65D 2585/86; B65D 88/1668; B65D 88/1681
USPC ..... 206/706, 386, 600; 383/907
See application file for complete search history.

(56) References Cited

U.S. PATENT DOCUMENTS

| | | | | |
|---|---|---|---|---|
| 4,069,853 | A | 1/1978 | Surabian | |
| 4,665,935 | A * | 5/1987 | Nichols | E04H 15/425 135/125 |
| D428,860 | S | 8/2000 | Siperek | |
| 6,263,617 | B1 * | 7/2001 | Turcot | E04H 15/20 52/2.13 |
| D472,531 | S | 4/2003 | Okuyama et al. | |
| 6,772,883 | B2 * | 8/2004 | Lindamood | A45F 3/04 206/320 |
| 6,968,880 | B2 * | 11/2005 | Battaglia | A45C 3/08 383/111 |
| 7,900,757 | B2 * | 3/2011 | Sisitsky | A45C 11/20 190/110 |
| 8,617,679 | B2 * | 12/2013 | Kreger | B65D 85/70 428/36.1 |

FOREIGN PATENT DOCUMENTS

| | | | |
|---|---|---|---|
| CN | 203102692 | U | 7/2013 |
| CN | 203102700 | U | 7/2013 |
| CN | 105913742 | A | 8/2016 |
| CN | 205428329 | U | 8/2016 |
| CN | 206194223 | U | 5/2017 |
| DE | 102004010021 | A1 | 9/2005 |

OTHER PUBLICATIONS

"Captair Pyramid,"2019 (c) Labotec.

* cited by examiner

*Primary Examiner* — King M Chu
(74) *Attorney, Agent, or Firm* — Nath, Goldberg & Meyer; Richard C. Litman

(57) ABSTRACT

The electronic circuit bag encloses a printed circuit board under design in an arrangement that allows for easy portability and ensures that the printed circuit board remains sterile during the design phase. The electronic circuit bag has a carrying handle atop the bag. The electronic circuit bag attaches to a solid square base which provides storage and a repository for holding the printed circuit board in place.

16 Claims, 1 Drawing Sheet

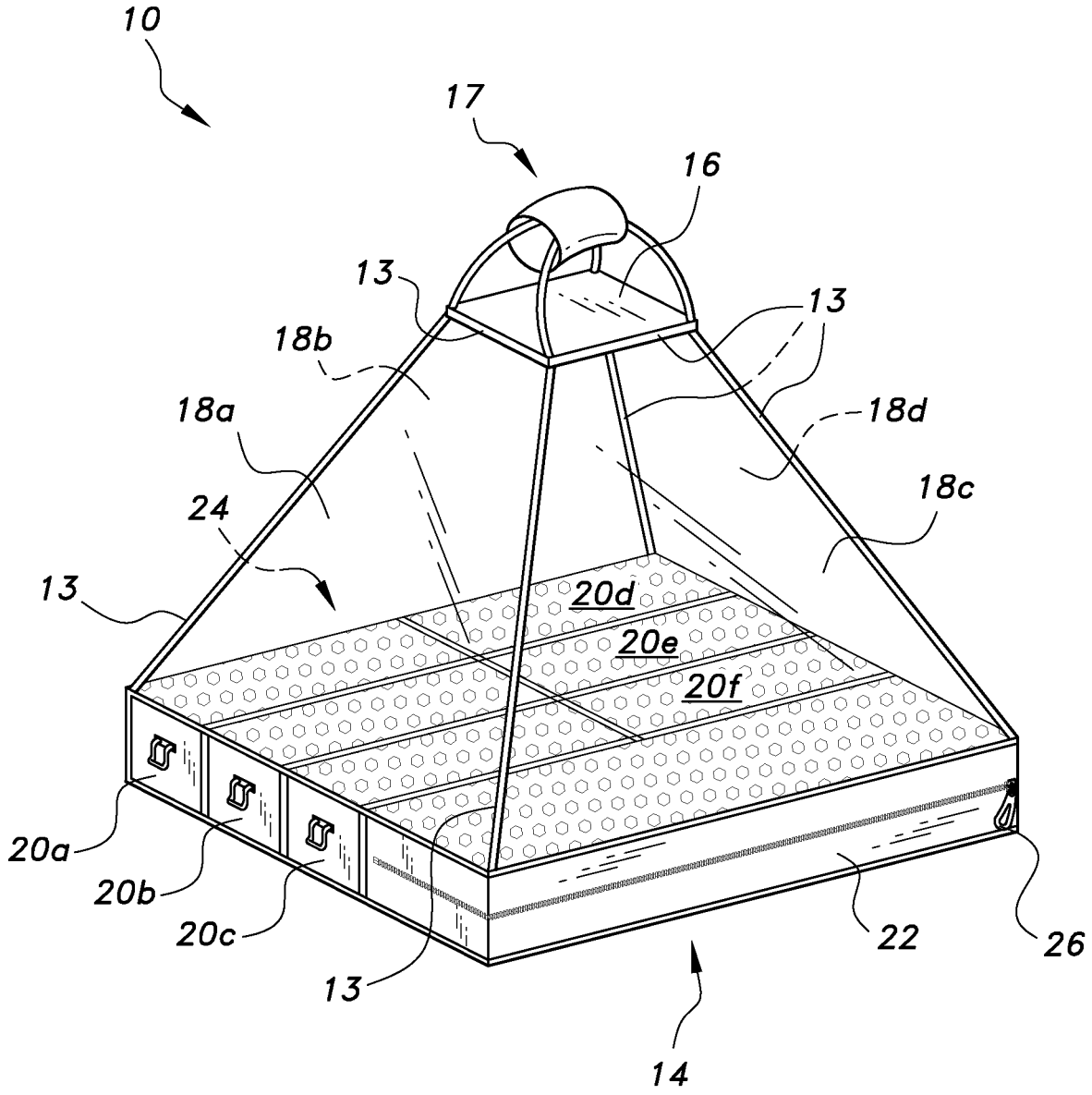
10
17
16
13
13
18b
18a
18d
18c
24
13
20d
20e
20f
20a
20b
20c
13
22
26
14

ELECTRONIC CIRCUIT BOARD BAG

BACKGROUND

I. Field

The disclosure of the present patent application relates to transportable storage items and, more particularly, to a bag for storing an electronic circuit board.

II. Description of the Prior Art

Electronic circuit boards, for example printed circuit boards ("PCBs"), are almost universally implemented in a wide variety of modern electronic devices. PCBs are used in the automotive, aviation, computer, smartphone, consumer electronics, and medical device industries, for example.

Many who handle electronic circuit boards have great difficulty transporting the board, wiring, ammeter, and other associated electronic parts from place to place safely and without exposure to dimming.

Accordingly, a bag for storing an electronic circuit board solving the aforementioned problems is desired.

SUMMARY

An electronic circuit hoard bag includes a housing defined by a generally rectangular base, a generally rectangular ceiling opposite the base, and four upright sides extending diagonally between sides the base and the ceiling. Each upright side is releasably secured to an adjacent upright side and to the ceiling with magnets or other suitable releasable fastener. In an embodiment, the upright sides are generally triangular and the ceiling is smaller than the base. The base can include a plurality of storage compartments, as described herein. In an embodiment, the ceiling includes a handle attached thereto.

These and other features of the present subject matter will become readily apparent upon further review of the following specification.

BRIEF DESCRIPTION OF THE DRAWINGS

The sole drawing FIGURE is a perspective view of the electronic circuit board bag.

DETAILED DESCRIPTION

An electronic circuit board bag 10 includes a housing 12 defined by a generally rectangular base 14, a generally rectangular ceiling 16 opposite the base 14, and four upright sides 18*a*-18*d* extending diagonally between the sides of the base 14 and the ceiling 16. The upright sides 18*a*-18*d* are releasably secured together and to the ceiling 16 along their edges with magnets 13 or other suitable releasable fastener. In an embodiment, the upright sides 18*a*-18*d* are generally triangular and the ceiling 16 is smaller than the base 14. The base 14 can include a plurality of storage compartments, as described herein. In an embodiment, the ceiling 16 includes a handle 17 attached thereto. An electronic circuit board can be placed on the base 14 within the housing 12 and the bag 10 can be used to store and transport the electronic circuit board.

In an embodiment, the electronic circuit board bag 10 has a generally pyramidal shape. Preferably, the upright sides 18*a*-18*d* are transparent so that a user can visually inspect a circuit board positioned on the base 14 within the housing

12. In an embodiment, the upright sides 18*a*-18*d* are flexible and the base 14 is rigid. For example, the base 14 can be formed from a rigid plastic, metal, or other suitable material. The upright sides 18*a*-18*d* can be formed from a flexible, transparent plastic or other suitable material. Preferably, a length and width of the base are equal, e.g., 30 centimeters. In an embodiment, the four upright sides 18*a*-18*d* of the bag 10 are foldable and adjacent sides are releasably connected to each other and the ceiling by magnets 13. While magnets are described herein, it should be understood that other suitable fasteners, e.g., clamps, clasps, clips, snaps or other suitable fastener may be used. In an embodiment, the handle 17 includes two loops extending from opposite sides of the ceiling 16 and a cylindrical sleeve connecting the loops.

A top surface of the base 14 can include a plurality of protrusions 24, e.g., rubber protrusions, extending therefrom. The protrusions 24 can provide friction to prevent sliding of an electronic circuit board placed on the base 14. In an embodiment, the storage compartments within the base 14 can include a plurality of drawers 20*a*-20*f* positioned along one or more sides of the base, e.g., opposing sides of the base, and a stationary storage compartment 22. The drawers 20*a*-20*f* can be slidably secured to the base 14. The drawers 20*a*-20*f* can provide adequate storage for various needed elements, e.g., tools, electric resistors, inductors, capacitors, condensers, switches, counters, registers, LEDs, diodes, ammeters, soldering irons, and such. A front face of each drawer can include a handle for a user to pull when desiring to remove an item from the drawer.

The stationary storage compartment 22 can be defined within the base 14 and can be larger than the individual drawers 20*a*-20*f*. An opening of the stationary storage compartment 22 can be closed using a detachable fastener, such as a zipper 26 or hook-and-loop fasteners. The stationary storage compartment can be useful for storing larger items, e.g., electronic circuit wires, within the base.

The bag 10 can be used to store and transport an electronic circuit board. For example, the bag can be used to transport an electronic circuit board under design from lab to lab. The transparent nature of the pyramidal housing 12 allows the user to visually inspect the circuit board under design to ensure that mounted chips and/or other components remain installed correctly or to spot any other defects in the board itself. As the upright sides 18*a*-18*d* of the electronic circuit bag 10 can be opened and closed, a user can easily insert an electronic circuit board into the bag and position it on the base 14 or remove the electronic circuit board therefrom. The pyramidal housing 12 further provides a vertical space for extending electronic circuitry wiring therein.

It is to be understood that the electronic circuit board bag is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. An electronic circuit board bag, comprising:

a rectangular base including at least one storage compartment within the base;

a rectangular ceiling spaced opposite from the base;

four upright sides extending diagonally between the sides of the base and the ceiling;

a plurality of releasable fasteners disposed along edges of the upright sides and the ceiling; and a handle secured to an outer surface of the ceiling, wherein the at least one storage compartment includes a plurality of drawers slidably secure within the base.

2. The electronic circuit board of claim 1, wherein the at least one storage compartment includes a stationary storage compartment.

3. The electronic circuit bag of claim 1, wherein the upright sides are foldable.

4. The electronic circuit bag of claim 1, wherein the releasably fasteners along the edges of the upright sides and the ceiling include magnets.

5. The electronic circuit bag of claim 1, wherein a top surface of the base includes a plurality of protrusions configured to prevent slipping of an electronic circuit board placed thereon.

6. An electronic circuit board bag, comprising:

a rectangular base;

a rectangular ceiling spaced opposite from the base;

four upright, foldable sides extending diagonally between the sides of the base and the ceiling;

a plurality of releasable fasteners disposed along edges of the upright sides and the ceiling; and a handle secured to an outer surface of the ceiling.

7. The electronic circuit board of claim 6, further comprising at least one storage compartment.

8. The electronic circuit board of claim 7, wherein the at least one storage compartment includes a plurality of a drawers slidably secured within the base.

9. The electronic circuit board of claim 8, wherein the at least one storage compartment includes a stationary storage compartment.

10. The electronic circuit board of claim 6, wherein the releasable fasteners along the edges of the upright sides and the ceiling include magnets.

11. The electronic circuit board of claim 6, wherein a top surface of the base includes a plurality of protrusions configured to prevent slipping an electronic circuit board placed thereon.

12. An electronic circuit board bag, comprising:

a rectangular base including a plurality of drawers slidably mounted within the base;

a rectangular ceiling spaced opposite from the base;

four upright extending diagonally between the sides of the base and the ceiling;

a plurality of releasable fasteners disposed along edges of the upright sides and the ceiling; and a handle secured to an outer surface of the ceiling.

13. The electronic circuit board of claim 1, further comprising at least one stationary storage compartment within the base.

14. The electronic circuit board of claim 1, wherein the upright sides are foldable.

15. The electronic circuit board of claim 1, wherein the releasable fasteners along the edges of upright sides and the ceiling include magnets.

16. The electronic circuit board of claim 1, wherein a top surface of the base includes a plurality of protrusions configured to prevent slipping of an electronic circuit board placed thereon.

* * * * *